US011692545B2

(12) United States Patent
Myers et al.

(10) Patent No.: US 11,692,545 B2
(45) Date of Patent: Jul. 4, 2023

(54) SUCTION COVER ASSEMBLY FOR RECIPROCATING PUMPS

(71) Applicant: SPM Oil & Gas Inc., Fort Worth, TX (US)

(72) Inventors: Jeff Myers, Fort Worth, TX (US); Adalberto Cortes, Fort Worth, TX (US); Richard David Peer, Fort Worth, TX (US)

(73) Assignee: SPM Oil & Gas Inc., Fort Worth, TX (US)

( * ) Notice: Subject to any disclaimer, the term of this patent is extended or adjusted under 35 U.S.C. 154(b) by 34 days.

(21) Appl. No.: 17/269,492

(22) PCT Filed: Aug. 20, 2019

(86) PCT No.: PCT/US2019/047326
§ 371 (c)(1),
(2) Date: Feb. 18, 2021

(87) PCT Pub. No.: WO2020/041359
PCT Pub. Date: Feb. 27, 2020

(65) Prior Publication Data

US 2021/0310484 A1 Oct. 7, 2021

Related U.S. Application Data

(60) Provisional application No. 62/720,112, filed on Aug. 20, 2018.

(51) Int. Cl.
*F04B 53/22* (2006.01)
*F04B 53/16* (2006.01)

(52) U.S. Cl.
CPC ..... *F04B 53/22* (2013.01); *F04B 53/16* (2013.01)

(58) Field of Classification Search
CPC ..... F04B 53/007; F04B 53/10; F04B 53/16; F04B 53/22; F04B 17/00; F04B 17/03; F04B 17/06; F04B 47/00; E21B 43/26
See application file for complete search history.

(56) References Cited

U.S. PATENT DOCUMENTS 4,860,995 A 8/1989 Rogers
7,364,412 B2 4/2008 Kugelev et al.
(Continued)

OTHER PUBLICATIONS

International Report on Patentability for International Patent Application No. PCT/US2019/047326 dated Mar. 4, 2021.
(Continued)

*Primary Examiner* — Charles G Freay
*Assistant Examiner* — Chirag Jariwala

(57) ABSTRACT

A suction cover assembly for a reciprocating pump assembly includes a suction cover having a body that is configured to be held at least partially within an access port of a fluid cylinder of the reciprocating pump assembly. The body includes a receptacle that includes at least one radial opening that extends through the body. The suction cover assembly includes a suction cover retainer that includes a plug configured to be at least partially received within the receptacle of the body. The suction cover retainer includes at least one retention segment configured to be held within the at least one radial opening of the body. The plug is configured to be moved between a locked position wherein the at least one retention segment is in a radially extended position and an unlocked position wherein the at least one retention segment is in a radially retracted position.

20 Claims, 8 Drawing Sheets

(56) References Cited

U.S. PATENT DOCUMENTS

| | | | | |
|---|---|---|---|---|
| 7,546,849 | B2 | 6/2009 | Staggs | |
| 2005/0155212 | A1* | 7/2005 | Crutchley | B21J 15/043 29/524.1 |
| 2010/0143163 | A1* | 6/2010 | Patel et al. | F04B 53/16 417/313 |
| 2016/0108910 | A1* | 4/2016 | Smith | F04B 53/007 49/35 |
| 2016/0208794 | A1 | 7/2016 | Singh et al. | |
| 2016/0245280 | A1* | 8/2016 | Todorov | F04B 53/10 |
| 2017/0298932 | A1 | 10/2017 | Wagner et al. | |

OTHER PUBLICATIONS

International Search Report and Written Opinion for International Patent Application No. PCT/US2019/047326 dated Nov. 19, 2019.

* cited by examiner

SUCTION COVER ASSEMBLY FOR RECIPROCATING PUMPS

CROSS-REFERENCE TO RELATED APPLICATION

This application is filed under 35 U.S.C. 371, and claims the benefit of and priority to PCT/US2019/047326, having a filing date of Aug. 20, 2019, entitled "SUCTION COVER ASSEMBLY FOR RECIPROCATING PUMPS," which claims the benefit of and priority to U.S. Provisional Patent Application No. 62/720,112 having a filing date of Aug. 20, 2018, entitled "THREADLESS RETAINER SYSTEM," both of which are incorporated herein by reference in their entirety for all purposes.

TECHNICAL FIELD

This disclosure relates to reciprocating pumps, and, in particular, to suction cover assemblies used in reciprocating pumps.

BACKGROUND

In oilfield operations, reciprocating pumps are used for different applications such as fracturing subterranean formations to drill for oil or natural gas, cementing the wellbore, or treating the wellbore and/or formation. A reciprocating pump designed for fracturing operations is sometimes referred to as a "frac pump." A reciprocating pump typically includes a power end section and a fluid end section. The fluid end section can be formed of a one piece construction or a series of blocks secured together by rods. The fluid end section includes a fluid cylinder (sometimes referred to as a cylinder section or a fluid end block) having a plunger bore for receiving a plunger, an inlet fluid passage, an outlet fluid passage (sometimes referred to as a discharge passage), and an access port. The inlet and outlet passages each include a valve assembly to control the flow of fluid into and out of the fluid cylinder. For example, the valve assemblies can be differential pressure valves that are opened by differential pressure of fluid and allow the fluid to flow in only one direction through the corresponding inlet or outlet passage.

The access port of reciprocating pumps is used to service the plunger and valve assemblies of the reciprocating pump, for example during field use where rapid maintenance and/or replacement may be important for the profitability of a well service operation. In the fluid cylinder of a reciprocating pump, the access port may be closed using a suction cover that is held in place with a suction cover nut that is threadably connected to the fluid cylinder, for example using buttress threads. But, despite the selection of relatively strong materials and the use of double shot peening and/or other hardening techniques, the relatively high cyclical loads on the suction cover may cause the threads to fatigue and ultimately fail. For example, the relatively high cyclical loads exerted on the suction cover nut during cyclical pumping of the reciprocating pump may impart an unequal load distribution along the axial length of the threads, may cause the threads of suction cover nuts and/or fluid cylinders to peel off, and/or may cause the suction cover nut to back out of the access port. Failure of the threaded connection between the suction cover nut and the fluid cylinder may cause the reciprocating pump to leak at the access port (e.g., the suction cover nut may weep well service fluid to the atmosphere through the threads) and/or may necessitate costly replacement of the suction cover nut and/or the fluid cylinder. Moreover, the threads may become dirty during field use of reciprocating pumps, which may hasten failure of the threads. The resulting maintenance operations required to clean the thread forms may increase the cost of maintaining reciprocating pumps.

SUMMARY

This summary is provided to introduce a selection of concepts in a simplified form that are further described below in the Detailed Description. This summary is not intended to identify key features or essential features of the claimed subject matter. Nor is it intended to be used as an aid in determining the scope of the claimed subject matter.

In a first aspect, a suction cover assembly for a reciprocating pump assembly includes a suction cover having a body that is configured to be held at least partially within an access port of a fluid cylinder of the reciprocating pump assembly. The body of the suction cover includes a receptacle that includes at least one radial opening that extends through the body. The suction cover assembly includes a suction cover retainer having a plug configured to be at least partially received within the receptacle of the body of the suction cover, the suction cover retainer includes at least one retention segment configured to be held within the at least one radial opening of the body of the suction cover. The plug is configured to be moved between a locked position wherein the at least one retention segment is in a radially extended position and an unlocked position wherein the at least one retention segment is in a radially retracted position.

In some embodiments, the plug is configured to be rotated between the locked position and the unlocked position In some embodiments, the plug includes a smaller diameter segment and a larger diameter segment. The larger diameter segment is configured to engage the at least one retention segment when the plug is in the locked position.

In some embodiments, the plug extends a length along a central plug axis. The plug is tapered inwardly along the length of the plug.

In some embodiments, the receptacle of the suction cover comprises a channel that extends a length within the body of the suction cover. The length of the channel includes an entrance segment and a locking segment. The suction cover retainer includes a pin configured to be held by the plug. An end portion of the pin is configured to extend within the locking segment of the channel when the plug is in the locked position.

In some embodiments, the receptacle of the suction cover includes a channel that extends a length within the body of the suction cover. The suction cover retainer includes a pin configured to be held by the plug. An end portion of the pin is configured to extend within the channel when the plug is received within the receptacle of the body of the suction cover. The length of the channel includes one of an L-shape or a U-shape.

In some embodiments, the suction cover assembly further includes a cap configured to be mounted to an end portion of the body of the suction cover.

In some embodiments, the suction cover assembly further includes a cap configured to be mounted to an end portion of the body of the suction cover. The cap includes a notch. The suction cover retainer includes a pin configured to be held by the plug. An end portion of the pin is configured to be received within the notch of the cap when the plug is in the unlocked position. The cap is configured to provide an axial stop to the end portion of the pin when the plug is in the locked position.

In some embodiments, the suction cover retainer includes a pin held by the plug. The pin defines a handle of the suction cover retainer.

In a second aspect, a suction cover assembly for a reciprocating pump assembly includes a suction cover having a body that is configured to be held at least partially within an access port of a fluid cylinder of the reciprocating pump assembly. The body of the suction cover extending a length along a central cover axis. The body of the suction cover includes a receptacle that includes at least one radial opening that extends through the body radially relative to the central cover axis. The suction cover assembly includes a suction cover retainer that includes a plug at least partially received within the receptacle of the body of the suction cover. The plug extends a length along a central plug axis. The suction cover retainer includes at least one retention segment held within the at least one radial opening of the body of the suction cover. The plug is configured to be rotated within the receptacle about the central plug axis between a locked position and an unlocked position. The at least one retention segment is configured to extend radially outward relative to the central plug axis into at least one groove of the access port in the locked position of the plug. The at least one retention segment is configured to be retracted relative to the central plug axis from the at least one groove of the access port in the unlocked position of the plug.

In some embodiments, the plug includes a smaller diameter segment and a larger diameter segment. The larger diameter segment is engaged with the at least one retention segment when the plug is in the locked position.

In some embodiments, the plug is tapered inwardly along the length of the plug.

In some embodiments, the receptacle of the suction cover includes a channel that extends a length within the body of the suction cover. The length of the channel includes an entrance segment and a locking segment. The suction cover retainer includes a pin held by the plug. An end portion of the pin extends within the locking segment of the channel when the plug is in the locked position.

In some embodiments, the suction cover assembly further includes a cap mounted to an end portion of the body of the suction cover. The cap includes a notch. The suction cover retainer includes a pin held by the plug. An end portion of the pin is received within the notch of the cap when the plug is in the unlocked position. The cap provides an axial stop to the end portion of the pin when the plug is in the locked position.

In a third aspect, a fluid end section for a reciprocating pump assembly includes a fluid cylinder that includes a pressure chamber and an access port. The access port extends along a central longitudinal axis. The access port includes at least one groove. The fluid end section includes a suction cover assembly that includes a suction cover having a body held at least partially within the access port of a fluid cylinder. The body includes a receptacle that includes at least one radial opening that extends through the body radially relative to the central longitudinal axis. The suction cover assembly includes a suction cover retainer that includes a plug at least partially received within the receptacle of the body of the suction cover. The suction cover retainer includes at least one retention segment held within the at least one radial opening of the body of the suction cover. The plug is rotatable within the receptacle between a locked position and an unlocked position. The at least one retention segment extends into at the least one groove of the access port in the locked position of the plug. The at least one retention segment is retracted from the at least one groove of the access port in the unlocked position of the plug.

In some embodiments, the plug of the suction cover retainer includes a smaller diameter segment and a larger diameter segment. The larger diameter segment is engaged with the at least one retention segment when the plug is in the locked position.

In some embodiments, wherein the plug of the suction cover extends a length along a central plug axis. The plug is tapered inwardly along the length of the plug.

In some embodiments, the receptacle of the suction cover includes a channel that extends a length within the body of the suction cover. The length of the channel includes an entrance segment and a locking segment. The suction cover retainer includes a pin held by the plug. An end portion of the pin extends within the locking segment of the channel when the plug is in the locked position.

In some embodiments, the suction cover assembly further includes a cap mounted to an end portion of the body of the suction cover. The cap includes a notch. The suction cover retainer includes a pin held by the plug. An end portion of the pin is received within the notch of the cap when the plug is in the unlocked position. The cap provides an axial stop to the end portion of the pin when the plug is in the locked position.

In some embodiments, the at least one groove of the access port includes a side wall that extends at an oblique angle relative to the central longitudinal axis of the access port.

Other aspects, features, and advantages will become apparent from the following detailed description when taken in conjunction with the accompanying drawings, which are a part of this disclosure and which illustrate, by way of example, principles of the inventions disclosed.

BRIEF DESCRIPTION OF THE DRAWINGS

The accompanying drawings facilitate an understanding of the various embodiments.

Corresponding reference characters indicate corresponding parts throughout the drawings.

DETAILED DESCRIPTION

Certain embodiments of the disclosure provide a suction cover assembly for a reciprocating pump assembly. The suction cover assembly includes a suction cover having a body that is configured to be held at least partially within an access port of a fluid cylinder of the reciprocating pump assembly. The body of the suction cover includes a receptacle that includes at least one radial opening that extends through the body. The suction cover assembly includes a suction cover retainer having a plug configured to be at least partially received within the receptacle of the body of the suction cover, the suction cover retainer includes at least one retention segment configured to be held within the at least one radial opening of the body of the suction cover. The plug is configured to be moved between a locked position wherein the at least one retention segment is in a radially extended position and an unlocked position wherein the at least one retention segment is in a radially retracted position.

Certain embodiments of the disclosure eliminate a threaded connection between a suction cover assembly and a fluid cylinder of a reciprocating pump assembly. Certain embodiments of the disclosure provide a reciprocating pump assembly that may require less service and/maintenance, which may limit the downtime of the reciprocating pump assembly and/or reduce costs thereby improving the profitability of a well service or other operation utilizing the reciprocating pump assembly.

Figure 1:
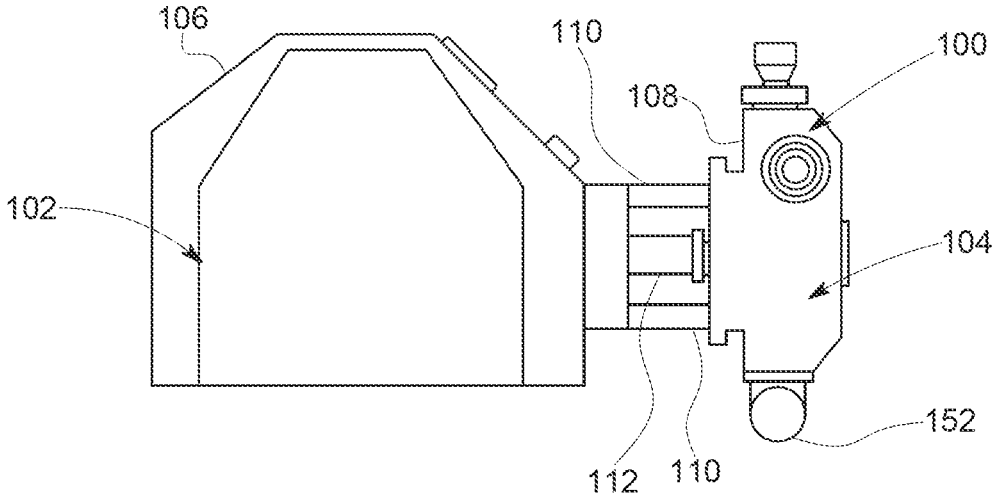
FIG. 1 is an elevational view of a reciprocating pump assembly according to an exemplary embodiment.

Referring to FIG. 1, an illustrative embodiment of a reciprocating pump assembly 100 is presented. The reciprocating pump assembly 100 includes a power end section 102 and a fluid end section 104 operably coupled thereto. The power end section 102 includes a housing 106 in which a crankshaft (not shown) is disposed. Rotation of the crankshaft is driven by an engine or motor (not shown) of the power end section 102. The fluid end section 104 includes a fluid cylinder 108 (sometimes referred to as a "fluid end block" or a "cylinder section"), which in the exemplary embodiments is connected to the housing 106 via a plurality of stay rods 110. Other structures may be used to connect the fluid end section 104 to the housing 106 in addition or alternatively to the stay rods 110. In operation, the crankshaft reciprocates a plunger rod assembly 112 between the power end section 102 and the fluid end section 104 to thereby pump (i.e., move) fluid through the fluid cylinder 108.

According to some embodiments, the reciprocating pump assembly 100 is freestanding on the ground, mounted to a trailer for towing between operational sites, mounted to a skid, loaded on a manifold, otherwise transported, and/or the like. The reciprocating pump assembly 100 is not limited to frac pumps or the plunger rod pump shown herein. Rather, the embodiments disclosed herein may be used with any other type of pump that includes a suction cover assembly.

Figure 2:
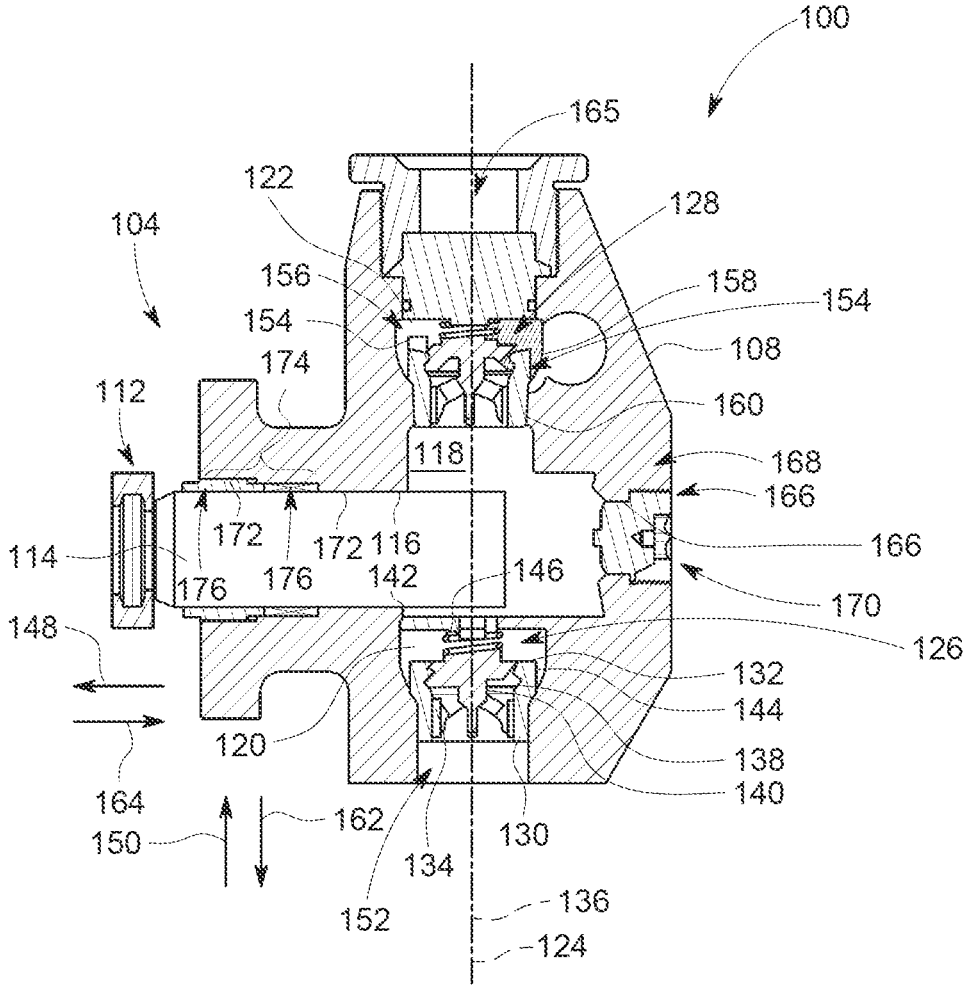
FIG. 2 is a cross-sectional view of a fluid end section of the reciprocating pump assembly shown in FIG. 1 according an exemplary embodiment.

Referring now to FIG. 2, the plunger rod assembly 112 includes a plunger 114 extending through a plunger bore 116 and into a pressure chamber 118 formed in the fluid cylinder 108. At least the plunger bore 116, the pressure chamber 118, and the plunger 114 together may be characterized as a "plunger throw." According to some embodiments, the reciprocating pump assembly 100 includes three plunger throws (i.e., a triplex pump assembly); however, in other embodiments, the reciprocating pump assembly 100 includes a greater or fewer number of plunger throws.

As shown in FIG. 2, the fluid cylinder 108 includes inlet and outlet fluid passages 120 and 122, respectively, formed therein. Optionally, the inlet and outlet fluid passages 120 and 122, respectively, are coaxially disposed along a fluid passage axis 124, for example as is shown in FIG. 2. Fluid is adapted to flow through the inlet and outlet fluid passages 120 and 122, respectively, and along the fluid passage axis 124. An inlet valve assembly 126 is disposed in the inlet fluid passage 120 and an outlet valve assembly 128 is disposed in the outlet fluid passage 122. In the exemplary embodiments, the valve assemblies 126 and 128 are spring-loaded, which, as described in greater detail below, are actuated by at least a predetermined differential pressure across each of the valve assemblies 126 and 128.

The inlet valve assembly 126 includes a valve seat 130 and a valve member 132 that is configured to be sealingly engaged therewith. The valve seat 130 includes an inlet valve bore 134 that extends along a valve seat axis 136 that is coaxial with the fluid passage axis 124 when the inlet valve assembly 126 is disposed in the inlet fluid passage 120. The valve seat 130 further includes a shoulder 138, which in the exemplary embodiment is tapered (i.e., extends at an oblique angle relative to the valve seat axis 136). In some other examples, the shoulder 138 of the valve seat 130 extends approximately perpendicular to the valve seat axis 136.

The valve member 132 includes a valve head 142 and a tail segment 140 extending from the valve head 142. As shown in FIG. 2, the tail segment 140 is received within the inlet valve bore 134 of the valve seat 130 when the inlet valve assembly 126 is assembled as shown. The valve head 142 includes a seal 144. The valve head 142 of the valve member 132 is moveable relative to the valve seat 130 along the valve seat axis 136 between an open position and a closed position. In the closed position of the valve member 132, the seal 144 of the valve head 142 sealingly engages the valve seat 130 to prevent fluid flow through the inlet valve assembly 126. In the exemplary embodiments, the valve member 132 is engaged and otherwise biased by a spring 146, which, as discussed in greater detail below, biases the valve member 132 to the closed position.

In the embodiments illustrated herein, the outlet valve assembly 128 is substantially similar to the inlet valve assembly 126 and therefore will not be described in further detail herein.

In operation, the plunger 114 reciprocates within the plunger bore 116 for movement into and out of the pressure chamber 118. That is, the plunger 114 moves back and forth horizontally, as viewed in FIG. 2, away from and towards the fluid passage axis 124 in response to rotation of the crankshaft (not shown) that is enclosed within the housing 106 (FIG. 1) of the power end section 102 (FIG. 1). Movement of the plunger 114 in the direction of arrow 148 away from the fluid passage axis 124 and out of the pressure chamber 118 will be referred to herein as the suction stroke of the plunger 114. As the plunger 114 moves along the suction stroke, the inlet valve assembly 126 is opened to the open position of the valve member 132. More particularly, as the plunger 114 moves away from the fluid passage axis 124 in the direction of arrow 148, the pressure inside the pressure chamber 118 decreases, creating a differential pressure across the inlet valve assembly 126 and causing the valve head 142 of the valve member 132 to move (relative to the valve seat 130) upward, as viewed in FIG. 2, along the valve seat axis 136 in the direction of arrow 150. As a result of the upward movement of the valve head 142 of the valve member 132 along the valve seat axis 136, the spring 146 is compressed and the valve head 142 of the valve member 132 separates from the shoulder 138 of the valve seat 130 to move the valve member 132 to the open position. In the open position of the valve member 132, fluid entering through an inlet 152 of the inlet fluid passage 120 flows along the fluid passage axis 124 and through the inlet valve assembly 126, being drawn into the pressure chamber 118. To flow through the inlet valve assembly 126, the fluid flows through the inlet valve bore 134 and along the valve seat axis 136. The inlet 152 defines a suction port of the fluid end section 104.

During the fluid flow through the inlet valve assembly 126 and into the pressure chamber 118, the outlet valve assembly 128 is in a closed position wherein a seal 154 of a valve member 156 of the outlet valve assembly 128 is sealingly engaged with a shoulder 158 of a valve seat 160 of the outlet valve assembly 128. Fluid continues to be drawn into the pressure chamber 118 until the plunger 114 is at the end of the suction stroke of the plunger 114, wherein the plunger 114 is at the farthest point from the fluid passage axis 124 of the range of motion of the plunger 114.

At the end of the suction stroke of the plunger 114, the differential pressure across the inlet valve assembly 126 is such that the spring 146 of the inlet valve assembly 126 begins to decompress and extend, forcing the valve head 142 of the valve member 132 of the inlet valve assembly 126 to move (relative to the valve seat 130) downward, as viewed in FIG. 2, along the valve seat axis 136 in the direction of arrow 162. As a result, the inlet valve assembly 126 moves to the closed position of the valve member 132 wherein the valve head 142 of the valve member 132 is sealingly engaged with the valve seat 130.

Movement of the plunger 114 in the direction of arrow 164 toward the fluid passage axis 124 and into the pressure chamber 118 will be referred to herein as the discharge stroke of the plunger 114. As the plunger 114 moves along the discharge stroke into the pressure chamber 118, the pressure within the pressure chamber 118 increases. The pressure within the pressure chamber 118 increases until the differential pressure across the outlet valve assembly 128 exceeds a predetermined set point, at which point the outlet valve assembly 128 opens and permits fluid to flow out of the pressure chamber 118 along the fluid passage axis 124, being discharged through an outlet 165 of the fluid end section 104 (through the outlet valve assembly 128). During the discharge stroke of the plunger 114, the valve member 132 of the inlet valve assembly 126 is positioned in the closed position wherein the valve head 142 of the valve member 132 is sealingly engaged with the valve seat 130. The outlet 165 of the fluid end section 104 defines a discharge port of the fluid end section 104.

The plunger bore 116 is defined by an inner wall 172 of the body 168 of the fluid cylinder 108. In other words, the plunger bore 116 includes the inner wall 172. As shown in FIG. 2, the plunger bore 116 includes a packing segment 174. The plunger rod assembly 112 includes packing 176 that is received within the packing segment 174 of the plunger bore 116 such that the packing 176 extends radially between the plunger 114 and the inner wall 172 to facilitate sealing the plunger 114 within the plunger bore 116 of the fluid cylinder 108.

Figure 3:
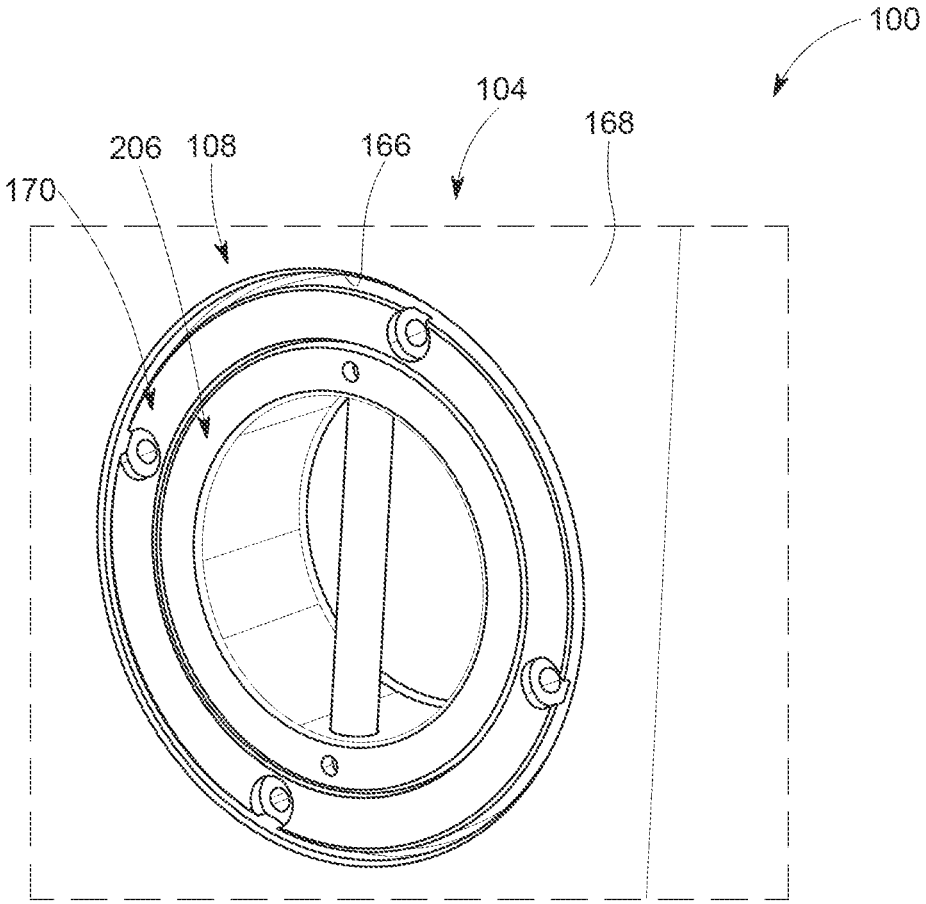
FIG. 3 is a perspective view of a portion of the fluid end section shown in FIG. 2 illustrating a suction cover assembly of the fluid end section according to an exemplary embodiment.

Referring now to FIGS. 2 and 3, the fluid cylinder 108 of the fluid end section 104 of the reciprocating pump assembly 100 includes an access port 166. The access port 166 is defined by an opening that extends through a body 168 of the fluid cylinder 108 to provide access to the pressure chamber 118 (not visible in FIG. 3) and thereby internal components of the fluid cylinder 108 (e.g., the inlet valve assembly 126, the outlet valve assembly 128, the plunger 114, etc.) for service (e.g., maintenance, replacement, etc.) thereof. The access port 166 of the fluid cylinder 108 is closed using a suction cover assembly 170 to seal the pressure chamber 118 of the fluid cylinder 108 at the access port 166.

The suction cover assembly 170 may be selectively removed to enable access to the pressure chamber 118 and thereby the internal components of the fluid cylinder 108. In some circumstances (e.g., during field use of the reciprocating pump assembly 100, etc.), it may be desirable to access and thereby service the internal components of the fluid cylinder 108 relatively quickly, for example to limit the downtime of the reciprocating pump assembly 100 wherein the reciprocating pump assembly 100 is non-operational. The capability of servicing the reciprocating pump assembly 100 as quickly as possible and thereby limiting the downtime thereof may improve the profitability of a well service or other operation utilizing the reciprocating pump assembly 100. The reciprocating pump assembly 100 is not limited to frac pumps or the plunger rod pump shown herein. Rather, the embodiments disclosed herein may be used with any other type of pump that includes an access port.

Figure 8:
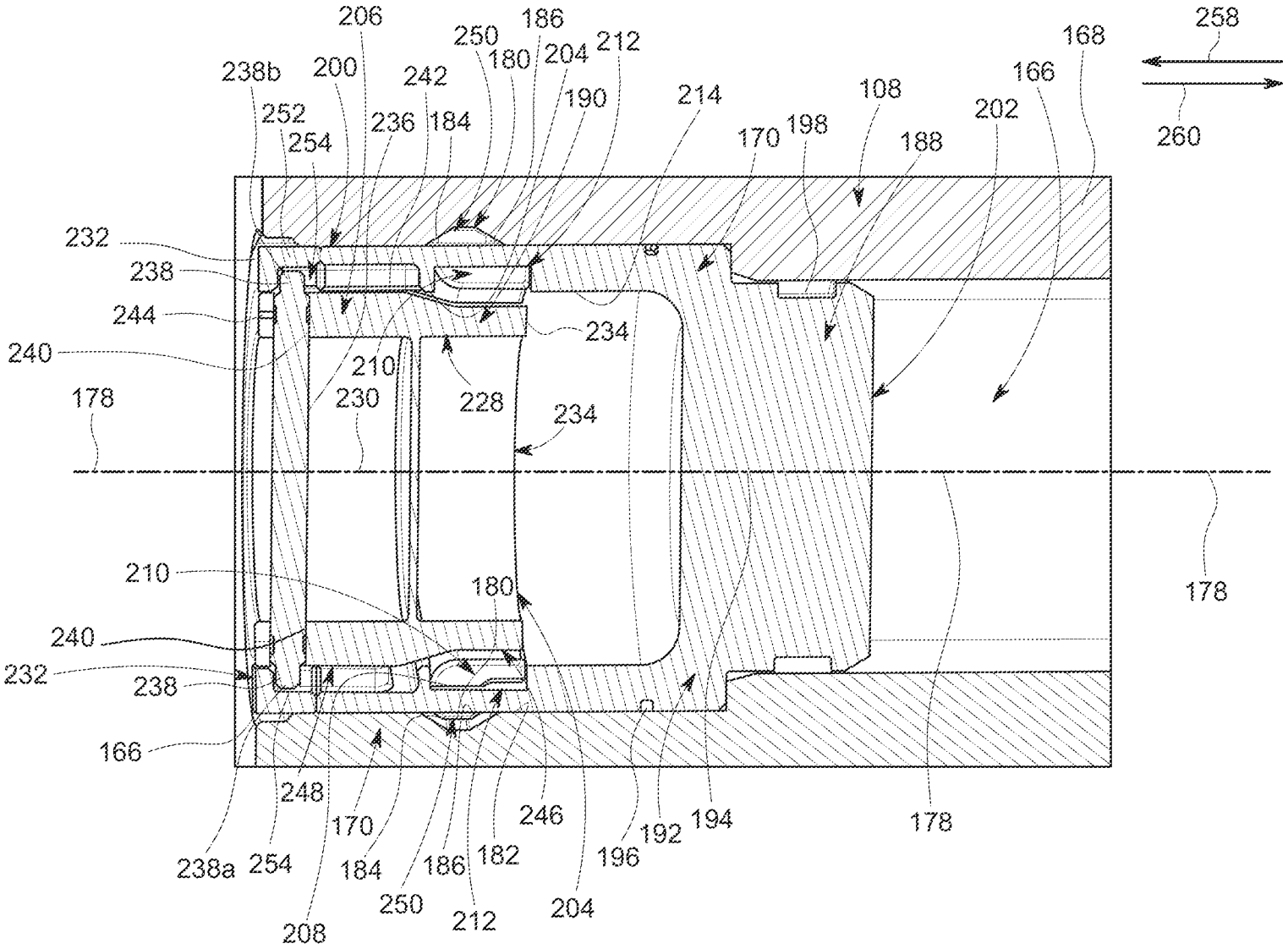
FIG. 8 is a cross-sectional view of the suction cover assembly shown in FIG. 3 illustrating an unlocked position according to an exemplary embodiment.

Referring now to FIG. 8, the access port 166 of the fluid cylinder 108 extends through the body 168 of the fluid cylinder 108 along a central longitudinal axis 178. The access port 166 includes at least one groove 180 that extends into an inner wall 182 of the fluid cylinder 108 that defines the access port 166. In the exemplary embodiment, side walls 184 and 186 of the groove 180 extend at an oblique angle relative to the central longitudinal axis 178, as can be seen in FIG. 8. In other embodiments, the side wall 184 and/or the side wall 186 extend at an approximately perpendicular angle relative to the central longitudinal axis 178.

Figure 4:
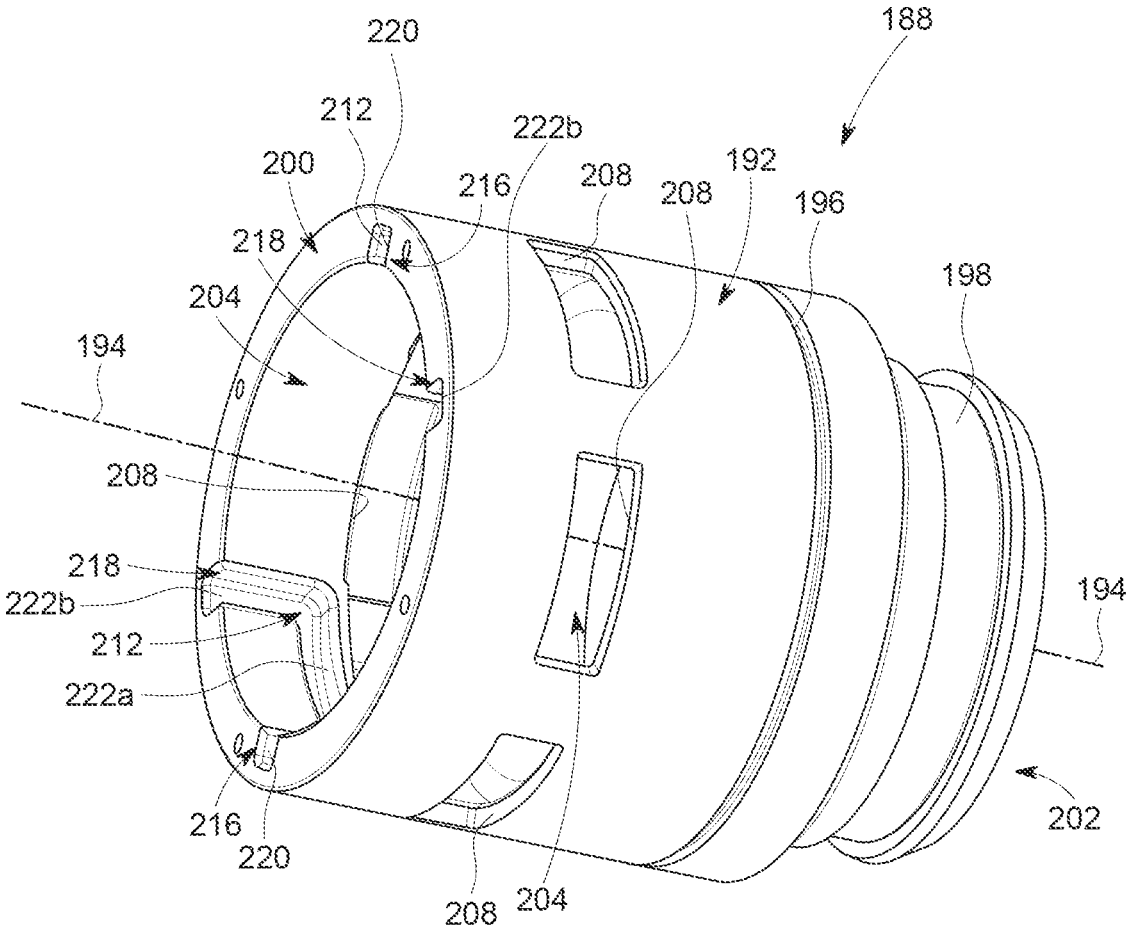
FIG. 4 is a perspective view of a suction cover of the suction cover assembly shown in FIG. 3 according to an exemplary embodiment.
Figure 5:
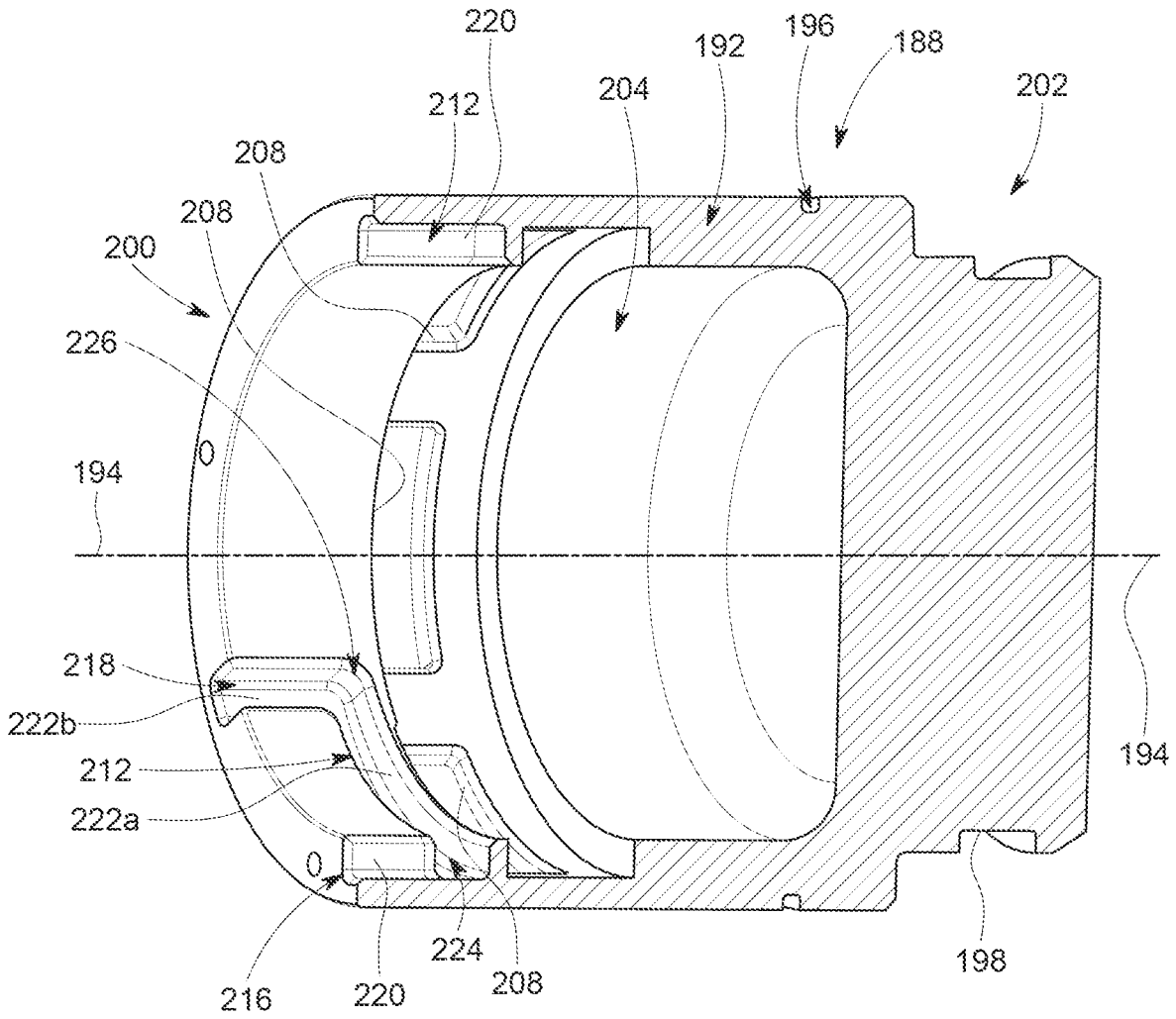
FIG. 5 is a perspective view illustrating a cross section of the suction cover shown in FIG. 4 according to an exemplary embodiment.

The suction cover assembly 170 includes a suction cover 188 and a suction cover retainer 190 that holds the suction cover 188 within the access port 166 of the fluid cylinder 108 during operation of the reciprocating pump assembly 100. Referring now to FIGS. 4, 5, and 8, the suction cover 188 includes a body 192 that extends along a central cover axis 194, which is optionally coaxial with the central longitudinal axis 178 (not visible in FIGS. 4 and 5) of the access port 166 (not shown in FIGS. 4 and 5) when the suction cover 188 is held within the access port 166. The body 192 of the suction cover 188 is held within the access port 166 by the suction cover retainer 190. The body 192 of the suction cover 188 optionally includes one or more sealing grooves 196 and/or 198 configured to hold a seal (not shown) that sealingly engages the inner wall 182 of the fluid cylinder 108 to facilitate sealing the suction cover 188 to the fluid cylinder 108 within the access port 166.

The body 192 of the suction cover 188 extends the length along the central cover axis 194 from an end portion 200 to an opposite end portion 202. The body 192 of the suction cover 188 includes a receptacle 204 that extends into the end portion 200 of the body 192 along the central cover axis 194. The receptacle 204 is configured to receive a plug 206 (not shown in FIGS. 4 and 5) of the suction cover retainer 190 (not shown in FIGS. 4 and 5) therein, for example as is shown in FIG. 8. The receptacle 204 includes one or more radial openings 208 that extend through the body 192 of the suction cover 188 radially relative to the central cover axis 194. As will be described below, each radial opening 208 is configured to hold a retention segment 210 (not shown in FIGS. 4 and 5) of the suction cover retainer 190 therein.

Although the exemplary embodiment of the suction cover 188 includes six radial openings 208, the suction cover 188 may include any other number of radial openings 208 for holding any number of retention segments 210. For example, in some other embodiments, the body 192 of the suction cover 188 includes a single radial opening 208 (for holding any number of retention segments 210) that extends along a portion of a circumference of the body 192.

The receptacle 204 of the suction cover 188 includes one or more channels 212 that extend into an inner wall 214 of the body 192 that defines the receptacle 204. Referring now solely to FIGS. 4 and 5, each channel 212 extends a length within the body 192 from an end portion 216 to an opposite end portion 218. The length of each channel 212 includes an entrance segment 220 and one or more locking segments 222. In the exemplary embodiment, each channel 212 includes two locking segments 222*a* and 222*b*. The entrance segment 220 includes the end portion 216 of the channel 212, while the locking segment 222*b* includes the end portion 218 of the channel 212. Although two are shown, the receptacle 204 may include any number of channels 212.

As shown in FIG. 5, each channel 212 includes a U-shape in the exemplary embodiment. Specifically, in the exemplary embodiment the locking segment 222*a* of each channel 212 extends a length from an end portion 224 to an opposite end portion 226, with the entrance segment 220 extending from the end portion 224 and the locking segment 222*b* extending from the end portion 226. In the exemplary embodiment, the length of the locking segment 222*a* extends approximately perpendicular to the central cover axis 194 with the entrance segment 220 and the locking segment 222*b* each extending approximately perpendicular to the length of the locking segment 222*a* and approximately parallel to the central cover axis 194. But, in other embodiments, the U-shape of the channel 212 may include: (1) a locking segment 222*a* having a length that extends at an oblique angle relative to the central cover axis 194 (e.g., a helical path around the central cover axis 194, etc.); (2) an entrance segment 220 that extends at an oblique angle relative to the length of the locking segment 222*a* and/or at an oblique angle relative to the central cover axis 194 (e.g., a helical path around the central cover axis 194, etc.); and/or (3) a locking segment 222*b* that extends at an oblique angle relative to the length of the locking segment 222*a* and/or at an oblique angle relative to the central cover axis 194 (e.g., a helical path around the central cover axis 194, etc.).

In other embodiments, one or more of the channels 212 has an L-shape. For example, a channel 212 may not include the locking segment 222*b* such that the length of the channel 212 is defined by the entrance segment 220 and the locking segment 222*a*, with the locking segment 222*a* including the end portion 226 of the channel 212. In embodiments wherein a channel 212 has an L-shape: (1) the length of the locking segment 222*a* may extend at an approximately perpendicular angle or at an oblique angle relative to the central cover axis 194 (e.g., a helical path around the central cover axis 194, etc.); the entrance segment 220 may extend at an approximately perpendicular angle or at an oblique angle relative to the length of the locking segment 222*a* (e.g., a helical path around the central cover axis 194, etc.); and/or (3) the entrance segment 220 may extend at an approximately parallel and/or at an oblique angle relative to the central cover axis 194 (e.g., a helical path around the central cover axis 194, etc.).

In yet another example, the channel 212 defines a bayonet-type connection wherein the entrance segment 220 defines a locking segment of the channel 212. For example, the entrance segment 220 may extend along a helical path around the central cover axis 194 from the end portion 216 to the end portion 218, with an optional bend, notch, and/or the like at the end portion 218 acting as a latch that holds the plug 206 of the suction cover retainer 190 in a locked position (e.g., the locked position described below and illustrated in FIG. 9, etc.)

Figure 6:
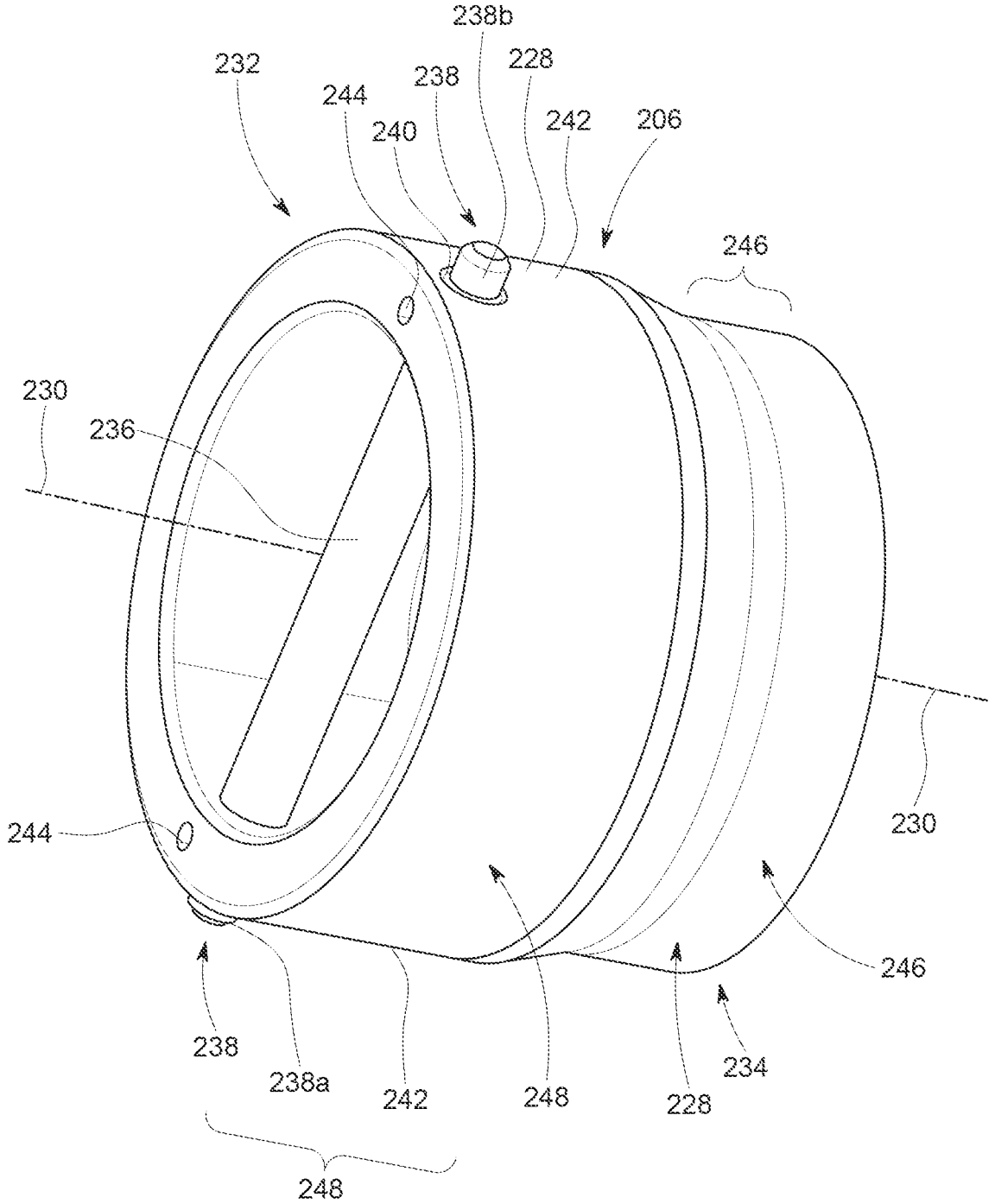
FIG. 6 is a perspective view of a portion of a suction cover retainer of the suction cover assembly shown in FIG. 3 according to an exemplary embodiment.

Referring now to FIGS. 6 and 8, the suction cover retainer 190 includes the plug 206 and the retention segments 210 (not shown in FIG. 6). The plug 206 includes a body 228 that is configured to be received within the receptacle 204 (not shown in FIG. 6) of the suction cover 188 (not shown in FIG. 6), for example as is shown in FIG. 8. The body 228 of the plug 206 extends along a central plug axis 230, which is optionally coaxial with the central longitudinal axis 178 (not visible in FIG. 6) of the access port 166 (not shown in FIG. 6) when the plug 188 is received within the receptacle 204 of the suction cover 188. The body 228 of the plug 206 extends the length along the central plug axis 230 from an end portion 232 to an opposite end portion 234. As will be described in more detail below, the plug 206 of the suction cover retainer 190 is configured to be moved (e.g., axially along the axis 178, rotated about the axis 230, etc.) between a locked position (e.g., the locked position shown in FIG. 9, etc.) that holds the suction cover 188 within the access port 166 (e.g., during operation of the reciprocating pump assembly 100, etc.) and an unlocked position (e.g., the unlocked position shown in FIG. 8, etc.) that enables the suction cover 188 to be removed from the access port 166.

The exemplary embodiment of the suction cover retainer 190 includes a pin 236 that is held by the plug 206. Specifically, the pin 236 extends a length between opposite end portions 238 (i.e., from an end portion 238*a* to an opposite end portion 238*b*). The body 228 of the plug 206 includes openings 240 at the end portion 232. The pin 236 is held by the end portion 232 of the plug 206 such that the pin 236 extends through the openings 240 with the end portions 238 extending radially outward (relative to the central plug axis 230) from an outer surface 242 of the body 228 of the plug 206.

The pin 236 may be held within the openings 240 with the end portions 238 extending radially outward using any method, means, structure, mechanism, manner, arrangement, connection, connector, device, and/or the like that enables the pin 236 to function as described and/or illustrated herein, such as, but not limited to, an adhesive, an interference fit, a snap-fit, a fastener (e.g., a threaded fastener, etc.), welding, brazing, an epoxy, a clip, a ring, a cotter pin, a quick release pin, and/or the like. In the exemplary embodiment, the end portion 232 of the plug 206 includes (any number of) set screw openings 244 that receive set screws (not shown) that engage the pin 236 to hold the pin 236 to the body 228 of the plug 206. Although shown as having a cylindrical shape, the pin 236 is not limited thereto, but rather additionally or alternatively may include any other shape that enables the pin 236 to function as described and/or illustrated herein, such as, but not limited to, a rectangular shape cross-sectional shape (e.g., a rectangular "bar" shape, a relatively flat "strip" shape, etc.), a quadrilateral cross-sectional shape, a triangular cross-sectional shape, etc.).

The body 228 of the plug 206 includes a smaller diameter segment 246 and a larger diameter segment 248. As will be described in more detail below, the larger diameter segment 248 is configured to engage the retention segments 210 when the plug 206 is in the locked position (e.g., the locked position shown in FIG. 9, etc.). In the exemplary embodiment, the body 228 of the plug 206 is tapered inwardly toward the central plug axis 230 along the length of the plug 206 (i.e., along the length of the central plug axis 230) to define the smaller and larger diameter segments 246 and 248, respectively. The body 228 of the plug 206 may be tapered inwardly at any angle to define the smaller and larger diameter segments 246 and 248, respectively, that enables the plug 206 to function as described and/or illustrated herein. In other examples, in addition or alternatively to being tapered inwardly, the body 228 of the plug 206 includes a stepped structure along the length of the plug 206 to define the smaller and larger diameter segments 246 and 248, respectively.

Figure 9:
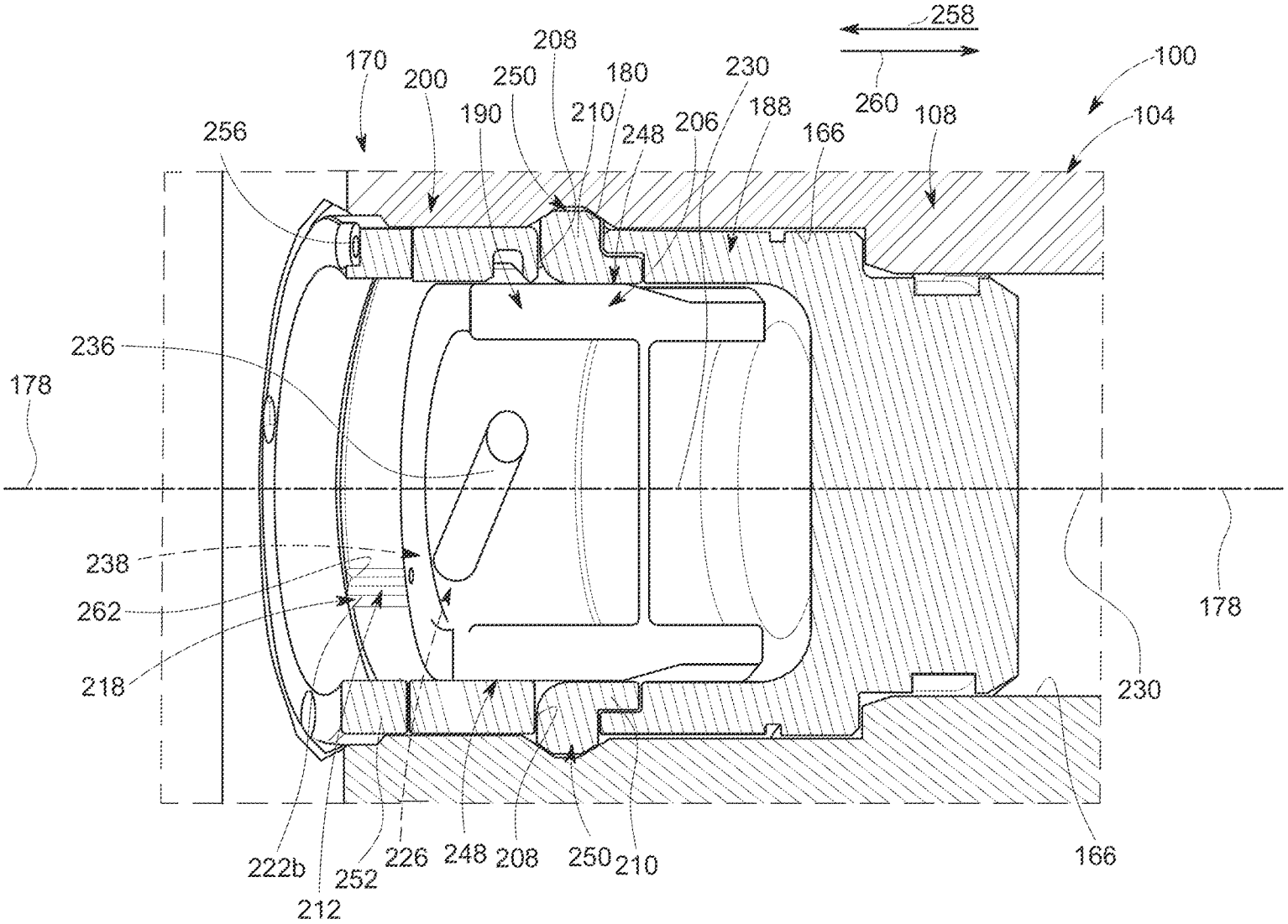
FIG. 9 is a cross-sectional view of the suction cover assembly shown in FIG. 3 illustrating a locked position according to an exemplary embodiment.

Referring now to FIGS. 8 and 9, the suction cover retainer 190 includes the retention segments 210, which as described above are held within the radial openings 208 of the suction cover 188 (e.g., as shown in FIGS. 8 and 9, etc.). As will be described below, end portions 250 of the retention segments 210 are configured to extend into the groove 180 of the access port 166 when the plug 206 is in the locked position, for example as is shown in FIG. 9. In the exemplary embodiment, sides of the retention segments 210 are angled obliquely relative to the central longitudinal axis 178, as is shown in FIGS. 8 and 9. In other embodiments, one or of the sides of one or more of the end portions 250 extends at an approximately perpendicular angle relative to the central longitudinal axis 178. Although shown as having an L-shape, additionally or alternatively one or more of the retention segments 210 includes any other shape that enables the retention segment 210 to function as described and/or illustrated herein. The suction cover retainer 190 may include any number of the retention segments 210.

Figure 7:
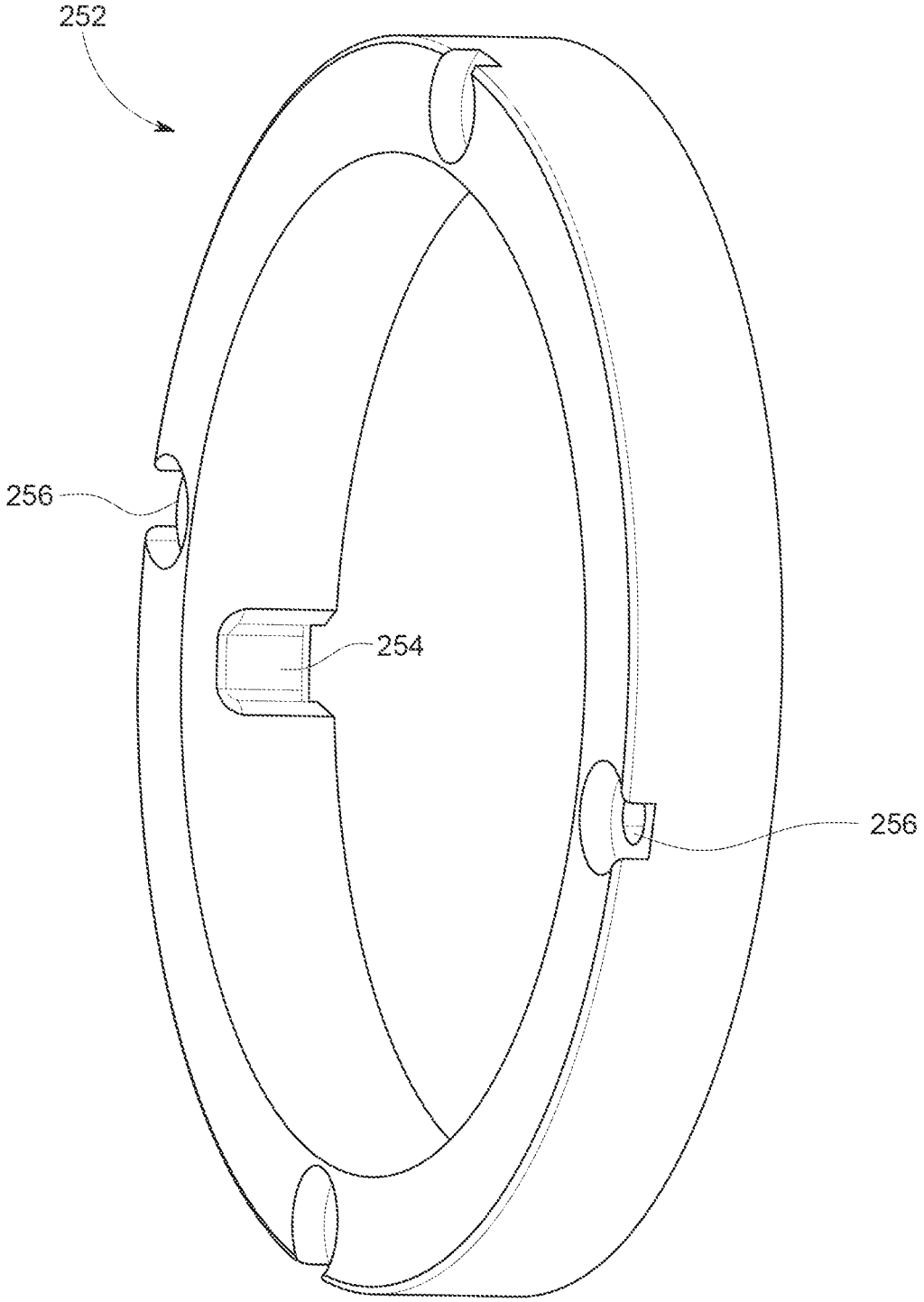
FIG. 7 is a perspective view of a cap of the suction cover assembly shown in FIG. 3 according to an exemplary embodiment.

Referring now to FIGS. 7-9, the suction cover assembly 170 optionally includes a cap 252 that is configured to be mounted to the end portion 200 (not shown in FIG. 7) of the suction cover 188 (not shown in FIG. 7). The cap 252 includes one or more notches 254 (not visible in FIG. 9) that are each configured to receive a corresponding end portion 238 (not shown in FIG. 7 and not visible in FIG. 9) of the pin 236 (not shown in FIG. 7) therein when the plug 206 (not shown in FIG. 7) is in the unlocked position, for example as shown in FIG. 8.

The cap 252 may be mounted to the suction cover 188 using any method, means, structure, mechanism, manner, arrangement, connection, connector, device, and/or the like that enables the cap 252 to function as described and/or illustrated herein, such as, but not limited to, an adhesive, an interference fit, a snap-fit, a fastener (e.g., a threaded fastener, etc.), welding, brazing, an epoxy, a clip, a ring, a cotter pin, a quick release pin, and/or the like. In the exemplary embodiment, the cap 252 includes (any number of) openings 256 (not visible in FIG. 8) that receive threaded fasteners (not shown) that threadedly interlock with the end portion 200 of the suction cover 188 to mount the cap 252 to the suction cover 188.

In operation, and referring now to FIG. 8, the plug 206 of the suction cover retainer 188 is shown in the exemplary unlocked position. FIG. 3 also illustrates the plug 206 in the exemplary unlocked position. In the unlocked position shown in FIG. 8, the end portions 238 of the pin 236 are received within the notches 254 of the cap 252 and the retention segments 210 are free to retract radially inward relative to the axes 178 and 230 from the groove 180 to radially retracted positions wherein the end portions 250 of the retention segments 210 do not extend into the groove 180 (e.g., clear the groove 180, etc.). The end portions 250 are shown only partially retracted in FIG. 8. Optionally, the retention segments 210 are biased to the radially retracted positions such that the retention segments 210 automatically retract to the radially retracted positions when the plug 206 is moved to the unlocked position. In the unlocked position of the plug 206, the suction cover assembly 170 can be removed from the access port 166 by moving (e.g., pulling on the pin 236, etc.) the suction cover assembly 170 along the axis 178 in the direction of the arrow 258. The optional angle of the side walls 184 and/or 186 (and/or optional angled sides of the end portions 256 of the retention segments 210) may facilitate removing the suction cover assembly 170 from the access port 166 by forcing the end portions 250 of the retention segments 210 radially inward such that the end portions 250 clear the groove 180 as the suction cover assembly 170 is moved along the axis 178 in the direction 258.

To lock the suction cover 188 within the access port 166, the plug 206 of the suction cover retainer 190 is moved from the unlocked position shown in FIG. 8 to the exemplary locked position shown in FIG. 9 by moving the plug axially along the axis 178 in the direction of the arrow 260 and by rotating the plug 206 about the axis 178. As the plug 206 is moved axially along the axis 178 in the direction 260, the end portions 238 of the pin 236 move through the entrance segment 220 (not visible in FIG. 9) of the corresponding channel 212 into the end portion 224 (shown in FIG. 5) of the locking segment **222*a* (not visible in FIG. 9) of the corresponding channel 212. As the plug 206 is moved axially in the direction 260, the larger diameter segment 248 of the plug 206 engages in physical contact with the retention segments 210 and thereby moves (e.g., forces, etc.) the retention segments radially outward relative to the axes 178 and 230 to radially extended positions thereof wherein the end portions 250 of the retention segments 210 extend radially outward relative to the axes 178 and 230 into the groove 180, as is shown in FIG. 9. As the plug 206 is rotated about the axis 178, the end portions 238 of the pin 236 move along the length of the locking segment 222*a* to the end portion 226 (best seen in FIG. 5) thereof such that the end portions 238 extend within the locking segments 222*a* and 222*b* to hold the plug 206 in the locked position. Accordingly, in the locked position shown in FIG. 9, the larger diameter segment 248 of the plug 206 is engaged with the retention segments 210 such that the end portions 250 of the retention segments 210 extend within the groove 180 to thereby hold the suction cover 188 within the access port 106**.

When the plug 206 is in the locked position shown in FIG. 9, the end portions 238 of the pin 236 may be free to float along the length of the locking segment **222*b*, which may allow some movement of the plug 206 along the axis 178 in the locked position. However, an end surface 262 of the cap 252 provides an axial stop to the end portions 238 of the pin 236 that prevents the plug 206 from moving sufficiently along the axis 178 in the direction 258 to disengage the larger diameter segment 248 of the plug 206 from the retention segments 210. In other words, the end surface 262 of the cap 252 prevents the end portions 238 of the pin 236 from exiting the locking segment 222*b* through the end portion 218 of the channel 212 in the locked position of the plug 206. Accordingly, the end surface 262 of the cap 252 provides an axial stop that holds the plug 206 in the locked position. The length of the entrance segment 220 and/or the length of the locking segment 222*b* may be selected to enable a predetermined amount of movement of the plug 206 along the axis 178** in the locked position. Although shown as moving from the unlocked position to the locked position by rotating in a clockwise direction about the axes 178 and 230, in other embodiments the plug 206 rotates from the unlocked position to the locked position in a counter-clockwise direction.

The amount of movement of the plug 206 along the axis 178 in the direction 260 (e.g., the length of the entrance segment 220, etc.) and/or the amount of rotation of the plug 206 about the axes 178 and 230 (e.g., the length of the locking segment 222*a*, etc.) may be selected to provide a visual indication that the suction cover retainer 188 is in the locked position.

In some embodiments, the pin 236 defines a handle of the suction cover retainer 190 that enables an operator to move the plug 206 between the locked and unlocked positions and/or that enables the operator to remove the suction cover assembly 170 from the access port 166, for example using a tool and/or the operator's hand.

Optionally, the cap 252 is removably mounted to the suction cover 188 such that the cap 252 can be removed from the suction cover 188 while the plug 206 of the suction cover retainer 190 is in the locked position. Removal of the cap 252 from the suction cover 188 while the suction cover retainer 190 is in the locked position enables the end portions 238 of the pin 236 to exit the channel 212 through the end portion 218 thereof. Accordingly, removal of the cap 252 enables the plug 206 to be removed from the receptacle 204 of the suction cover 188 in the event that one or more components of the suction cover assembly 170 is jammed in the locked position, which may enable the suction cover assembly 170 to be disassembled and thereby removed from the access port 166 while in the locked position.

Various embodiments disclosed herein eliminate a threaded connection between a suction cover assembly and a fluid cylinder of a reciprocating pump assembly. Various embodiments disclosed herein provide a reciprocating pump assembly that may require less service and/maintenance, which may limit the downtime of the reciprocating pump assembly and/or reduce costs thereby improving the profitability of a well service or other operation utilizing the reciprocating pump assembly.

The following clauses describe further aspects of the disclosure:

Clause Set A:

A1. A suction cover assembly for a reciprocating pump assembly, said suction cover assembly comprising:

a suction cover having a body that is configured to be held at least partially within an access port of a fluid cylinder of the reciprocating pump assembly, the body of the suction cover comprising a receptacle that includes at least one radial opening that extends through the body; and a suction cover retainer comprising a plug configured to be at least partially received within the receptacle of the body of the suction cover, the suction cover retainer comprising at least one retention segment configured to be held within the at least one radial opening of the body of the suction cover, wherein the plug is configured to be moved between a locked position wherein the at least one retention segment is in a radially extended position and an unlocked position wherein the at least one retention segment is in a radially retracted position.

A2. The suction cover assembly of clause A1, wherein the plug is configured to be rotated between the locked position and the unlocked position.

A3. The suction cover assembly of clause A1, wherein the plug comprises a smaller diameter segment and a larger diameter segment, the larger diameter segment being configured to engage the at least one retention segment when the plug is in the locked position.

A4. The suction cover assembly of clause A1, wherein the plug extends a length along a central plug axis, the plug being tapered inwardly along the length of the plug.

A5. The suction cover assembly of clause A1, wherein the receptacle of the suction cover comprises a channel that extends a length within the body of the suction cover, the length of the channel comprising an entrance segment and a locking segment, the suction cover retainer comprising a pin configured to be held by the plug, an end portion of the pin being configured to extend within the locking segment of the channel when the plug is in the locked position.

A6. The suction cover assembly of clause A1, wherein the receptacle of the suction cover comprises a channel that extends a length within the body of the suction cover, the suction cover retainer comprising a pin configured to be held by the plug, an end portion of the pin being configured to extend within the channel when the plug is received within the receptacle of the body of the suction cover, wherein the length of the channel comprises one of an L-shape or a U-shape.

A7. The suction cover assembly of clause A1, further comprising a cap configured to be mounted to an end portion of the body of the suction cover.

A8. The suction cover assembly of clause A1, further comprising a cap configured to be mounted to an end portion of the body of the suction cover, the cap comprising a notch, the suction cover retainer comprising a pin configured to be held by the plug, an end portion of the pin being configured to be received within the notch of the cap when the plug is in the unlocked position, the cap being configured to provide an axial stop to the end portion of the pin when the plug is in the locked position.

A9. The suction cover assembly of clause A1, wherein the suction cover retainer comprises a pin held by the plug, the pin defining a handle of the suction cover retainer.

Clause Set B:

B1. A suction cover assembly for a reciprocating pump assembly, said suction cover assembly comprising:

a suction cover having a body that is configured to be held at least partially within an access port of a fluid cylinder of the reciprocating pump assembly, the body of the suction cover extending a length along a central cover axis, the body of the suction cover comprising a receptacle that includes at least one radial opening that extends through the body radially relative to the central cover axis; and a suction cover retainer comprising a plug at least partially received within the receptacle of the body of the suction cover, the plug extending a length along a central plug axis, the suction cover retainer comprising at least one retention segment held within the at least one radial opening of the body of the suction cover, the plug being configured to be rotated within the receptacle about the central plug axis between a locked position and an unlocked position, wherein the at least one retention segment is configured to extend radially outward relative to the central plug axis into at least one groove of the access port in the locked position of the plug, and wherein the at least one retention segment is configured to be retracted relative to the central plug axis from the at least one groove of the access port in the unlocked position of the plug.

B2. The suction cover assembly of clause B1, wherein the plug comprises a smaller diameter segment and a larger diameter segment, the larger diameter segment being engaged with the at least one retention segment when the plug is in the locked position.

B3. The suction cover assembly of clause B1, wherein the plug is tapered inwardly along the length of the plug.

B4. The suction cover assembly of clause B1, wherein the receptacle of the suction cover comprises a channel that extends a length within the body of the suction cover, the length of the channel comprising an entrance segment and a locking segment, the suction cover retainer comprising a pin held by the plug, an end portion of the pin extending within the locking segment of the channel when the plug is in the locked position.

B5. The suction cover assembly of clause B1, further comprising a cap mounted to an end portion of the body of the suction cover, the cap comprising a notch, the suction cover retainer comprising a pin held by the plug, an end portion of the pin being received within the notch of the cap when the plug is in the unlocked position, the cap providing an axial stop to the end portion of the pin when the plug is in the locked position.

Clause Set C:

C1. A fluid end section for a reciprocating pump assembly, the fluid end section comprising:

a fluid cylinder comprising a pressure chamber and an access port, the access port extending along a central longitudinal axis, the access port comprising at least one groove; and a suction cover assembly comprising:

a suction cover having a body held at least partially within the access port of a fluid cylinder, the body comprising a receptacle that includes at least one radial opening that extends through the body radially relative to the central longitudinal axis; and a suction cover retainer comprising a plug at least partially received within the receptacle of the body of the suction cover, the suction cover retainer comprising at least one retention segment held within the at least one radial opening of the body of the suction cover, the plug being rotatable within the receptacle between a locked position and an unlocked position, wherein the at least one retention segment extends into at the least one groove of the access port in the locked position of the plug, and wherein the at least one retention segment is retracted from the at least one groove of the access port in the unlocked position of the plug.

C2. The fluid end section of clause C1, wherein the plug of the suction cover retainer comprises a smaller diameter segment and a larger diameter segment, the larger diameter segment being engaged with the at least one retention segment when the plug is in the locked position.

C3. The fluid end section of clause C1, wherein the plug of the suction cover extends a length along a central plug axis, the plug being tapered inwardly along the length of the plug.

C4. The fluid end section of clause C1, wherein the receptacle of the suction cover comprises a channel that extends a length within the body of the suction cover, the length of the channel comprising an entrance segment and a locking segment, the suction cover retainer comprising a pin held by the plug, an end portion of the pin extending within the locking segment of the channel when the plug is in the locked position.

C5. The fluid end section of the clause C1, further comprising a cap mounted to an end portion of the body of the suction cover, the cap comprising a notch, the suction cover retainer comprising a pin held by the plug, an end portion of the pin being received within the notch of the cap when the plug is in the unlocked position, the cap providing an axial stop to the end portion of the pin when the plug is in the locked position.

C6. The fluid end section of clause C1, wherein the at least one groove of the access port comprises a side wall that extends at an oblique angle relative to the central longitudinal axis of the access port.

It is to be understood that the above description is intended to be illustrative, and not restrictive. For example, the above-described embodiments (and/or aspects thereof) may be used in combination with each other. Furthermore, invention(s) have been described in connection with what are presently considered to be the most practical and preferred embodiments, it is to be understood that the invention is not to be limited to the disclosed embodiments, but on the contrary, is intended to cover various modifications and equivalent arrangements included within the spirit and scope of the invention(s). Further, each independent feature or component of any given assembly may constitute an additional embodiment. In addition, many modifications may be made to adapt a particular situation or material to the teachings of the disclosure without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the disclosure should, therefore, be determined with reference to the appended claims, along with the full scope of equivalents to which such claims are entitled.

In the foregoing description of certain embodiments, specific terminology has been resorted to for the sake of clarity. However, the disclosure is not intended to be limited to the specific terms so selected, and it is to be understood that each specific term includes other technical equivalents which operate in a similar manner to accomplish a similar technical purpose. Terms such as "clockwise" and "counterclockwise", "left" and right", "front" and "rear", "above" and "below" and the like are used as words of convenience to provide reference points and are not to be construed as limiting terms.

When introducing elements of aspects of the disclosure or the examples thereof, the articles "a," "an," "the," and "said" are intended to mean that there are one or more of the elements. The terms "comprising," "including," and "having" are intended to be inclusive and mean that there may be additional elements other than the listed elements. For example, in this specification, the word "comprising" is to be understood in its "open" sense, that is, in the sense of "including", and thus not limited to its "closed" sense, that is the sense of "consisting only of". A corresponding meaning is to be attributed to the corresponding words "comprise", "comprised", "comprises", "having", "has", "includes", and "including" where they appear. Further, references to "one embodiment" are not intended to be interpreted as excluding the existence of additional embodiments that also incorporate the recited features. Moreover, unless explicitly stated to the contrary, embodiments "comprising" or "having" an element or a plurality of elements having a particular property can include additional elements not having that property. The term "exemplary" is intended to mean "an example of." The phrase "one or more of the following: A, B, and C" means "at least one of A and/or at least one of B and/or at least one of C." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112(f), unless and until such claim limitations expressly use the phrase "means for" followed by a statement of function void of further structure.

Although the terms "step" and/or "block" may be used herein to connote different elements of methods employed, the terms should not be interpreted as implying any particular order among or between various steps herein disclosed unless and except when the order of individual steps is explicitly described. The order of execution or performance of the operations in examples of the disclosure illustrated and described herein is not essential, unless otherwise specified. The operations may be performed in any order, unless otherwise specified, and examples of the disclosure may include additional or fewer operations than those disclosed herein. It is therefore contemplated that executing or performing a particular operation before, contemporaneously with, or after another operation is within the scope of aspects of the disclosure.

Having described aspects of the disclosure in detail, it will be apparent that modifications and variations are possible without departing from the scope of aspects of the disclosure as defined in the appended claims. As various changes could be made in the above constructions, products, and methods without departing from the scope of aspects of the disclosure, it is intended that all matter contained in the above description and shown in the accompanying drawings shall be interpreted as illustrative and not in a limiting sense.

What is claimed is:

1. A suction cover assembly for a reciprocating pump assembly, said suction cover assembly comprising:

a suction cover having a body that is configured to be held at least partially within an access port of a fluid cylinder of the reciprocating pump assembly, the body of the suction cover comprising a receptacle that includes at least one radial opening that extends through the body, and a suction cover retainer comprising a plug configured to be at least partially received within the receptacle of the body of the suction cover, the suction cover retainer comprising at least one retention segment configured to be held within the at least one radial opening of the body of the suction cover, wherein the plug is configured to be moved axially between a locked position wherein the at least one retention segment is moved radially to a radially extended position and an unlocked position wherein the at least one retention segment is moved radially to a radially retracted position.

2. The suction cover assembly of claim 1, wherein the plug is configured to be rotated between the locked position and the unlocked position.

3. The suction cover assembly of claim 1, wherein the plug comprises a smaller diameter segment and a larger diameter segment, the larger diameter segment being configured to engage the at least one retention segment when the plug is in the locked position.

4. The suction cover assembly of claim 1, wherein the plug extends a length along a central plug axis, the plug being tapered inwardly along the length of the plug.

5. The suction cover assembly of claim 1, wherein the receptacle of the suction cover comprises a channel that extends a length within the body of the suction cover, the length of the channel comprising an entrance segment and a locking segment, the suction cover retainer comprising a pin configured to be held by the plug, an end portion of the pin being configured to extend within the locking segment of the channel when the plug is in the locked position.

6. The suction cover assembly of claim 1, wherein the receptacle of the suction cover comprises a channel that extends a length within the body of the suction cover, the suction cover retainer comprising a pin configured to be held by the plug, an end portion of the pin being configured to extend within the channel when the plug is received within the receptacle of the body of the suction cover, wherein the length of the channel comprises one of an L-shape or a U-shape.

7. The suction cover assembly of claim 1, further comprising a cap configured to be mounted to an end portion of the body of the suction cover.

8. The suction cover assembly of claim 1, further comprising a cap configured to be mounted to an end portion of the body of the suction cover, the cap comprising a notch, the suction cover retainer comprising a pin configured to be held by the plug, an end portion of the pin being configured to be received within the notch of the cap when the plug is in the unlocked position, the cap being configured to provide an axial stop to the end portion of the pin when the plug is in the locked position.

9. The suction cover assembly of claim 1, wherein the suction cover retainer comprises a pin held by the plug, the pin defining a handle of the suction cover retainer.

10. A suction cover assembly for a reciprocating pump assembly, said suction cover assembly comprising:

a suction cover having a body that is configured to be held at least partially within an access port of a fluid cylinder of the reciprocating pump assembly, the body of the suction cover extending a length along a central cover axis, the body of the suction cover comprising a receptacle that includes at least one radial opening that extends through the body radially relative to the central cover axis, wherein the at least one radial opening extends, in a radial direction, from an inner wall of the body that defines the receptacle to an outer wall of the body proximate an inner wall of the fluid cylinder that defines the access port; and a suction cover retainer comprising a plug at least partially received within the receptacle of the body of the suction cover, the plug extending a length along a central plug axis, the suction cover retainer comprising at least one retention segment held within the at least one radial opening of the body of the suction cover, the plug being configured to be rotated within the receptacle about the central plug axis between a locked position and an unlocked position, wherein the at least one retention segment is configured to extend radially outward relative to the central plug axis into at least one groove of the access port in the locked position of the plug, and wherein the at least one retention segment is configured to be retracted relative to the central plug axis from the at least one groove of the access port in the unlocked position of the plug.

11. The suction cover assembly of claim 10, wherein the plug comprises a smaller diameter segment and a larger diameter segment, the larger diameter segment being engaged with the at least one retention segment when the plug is in the locked position.

12. The suction cover assembly of claim 10, wherein the plug is tapered inwardly along the length of the plug.

13. The suction cover assembly of claim 10, wherein the receptacle of the suction cover comprises a channel that extends a length within the body of the suction cover, the length of the channel comprising an entrance segment and a locking segment, the suction cover retainer comprising a pin held by the plug, an end portion of the pin extending within the locking segment of the channel when the plug is in the locked position.

14. The suction cover assembly of claim 10, further comprising a cap mounted to an end portion of the body of the suction cover, the cap comprising a notch, the suction cover retainer comprising a pin held by the plug, an end portion of the pin being received within the notch of the cap when the plug is in the unlocked position, the cap providing an axial stop to the end portion of the pin when the plug is in the locked position.

15. A fluid end section for a reciprocating pump assembly, the fluid end section comprising:

a fluid cylinder comprising a pressure chamber and an access port, the access port extending along a central longitudinal axis, the access port comprising at least one groove; and a suction cover assembly comprising:

a suction cover having a body held at least partially within the access port of the fluid cylinder, the body comprising a receptacle that includes at least one radial opening that extends through the body radially relative to the central longitudinal axis; and a suction cover retainer comprising a plug at least partially received within the receptacle of the body of the suction cover, the suction cover retainer comprising at least one retention segment held within the at least one radial opening of the body of the suction cover, the plug being rotatable within the receptacle between a locked position and an unlocked position, wherein the at least one retention segment moves radially outwardly to extend into the at least one groove of the access port in the locked position of the plug, and wherein the at least one retention segment moves radially inwardly to retract from the at least one groove of the access port in the unlocked position of the plug.

16. The fluid end section of claim 15, wherein the plug of the suction cover retainer comprises a smaller diameter segment and a larger diameter segment, the larger diameter segment being engaged with the at least one retention segment when the plug is in the locked position.

17. The fluid end section of claim 15, wherein the plug of the suction cover extends a length along a central plug axis, the plug being tapered inwardly along the length of the plug.

18. The fluid end section of claim 15, wherein the receptacle of the suction cover comprises a channel that extends a length within the body of the suction cover, the length of the channel comprising an entrance segment and a locking segment, the suction cover retainer comprising a pin held by the plug, an end portion of the pin extending within the locking segment of the channel when the plug is in the locked position.

19. The fluid end section of the claim 15, wherein the suction cover assembly further comprises a cap mounted to an end portion of the body of the suction cover, the cap comprising a notch, the suction cover retainer comprising a pin held by the plug, an end portion of the pin being received within the notch of the cap when the plug is in the unlocked position, the cap providing an axial stop to the end portion of the pin when the plug is in the locked position.

20. The fluid end section of claim 15, wherein the at least one groove of the access port comprises a side wall that extends at an oblique angle relative to the central longitudinal axis of the access port.

* * * * *